US005791389A

United States Patent [19]

Valdez

[11] Patent Number: 5,791,389

[45] Date of Patent: Aug. 11, 1998

[54] APPARATUS AND METHOD FOR FORMING FIREWOOD LOGS

[75] Inventor: Charlie Valdez, Selma, Oreg.

[73] Assignee: Yvonne Company, Selma, Oreg.

[21] Appl. No.: 828,306

[22] Filed: Mar. 28, 1997

[51] Int. Cl.[6] ..... B27L 7/00

[52] U.S. Cl. ..... 144/366; 144/4.6; 144/195.1; 144/195.8; 144/367

[58] Field of Search ..... 144/4.6, 193.1, 144/195.1, 195.8, 366, 367

[56] References Cited

U.S. PATENT DOCUMENTS

| | | | |
|---|---|---|---|
| 4,286,638 | 9/1981 | Connolly et al. | 144/4.6 |
| 4,373,564 | 2/1983 | Heikkinen | 144/366 |
| 4,478,263 | 10/1984 | Johnston | 144/4.6 |
| 4,782,866 | 11/1988 | Valdez | 144/195.8 |
| 4,830,070 | 5/1989 | Nunnery et al. | 144/195.1 |
| 4,830,071 | 5/1989 | Gollahon | 144/195.1 |
| 4,875,514 | 10/1989 | Hollister, Jr. | 144/367 |

FOREIGN PATENT DOCUMENTS

| | | | |
|---|---|---|---|
| 0 054 252 | 6/1982 | European Pat. Off. | B27L 7/00 |

*Primary Examiner*—W. Donald Bray

*Attorney, Agent, or Firm*—Joseph J. Kelly, Esq.; Klaas, Law, O'Meara & Malkin, P.C.

[57] ABSTRACT

Apparatus and method for processing relatively large tree logs into relatively small firewood logs using two spaced apart cutting stations, a central conveyor, a transfer station and a splitter station wherein relatively large tree logs are placed sequentially onto an entrance portion of each of the two spaced apart cutting stations and are cut into rounds which are discharged onto the conveyor and moved to a transfer station. Each round is moved into a splitter station wherein each round is moved over splitter blades to form firewood logs. The splitter blades are mounted in support members secured to a square frame having spaced apart opposite sidewalls wherein the distance between each two aligned support members is greater than the distance between opposite sidewalls.

20 Claims, 3 Drawing Sheets

APPARATUS AND METHOD FOR FORMING FIREWOOD LOGS

FIELD OF THE INVENTION

This invention relates generally to wood processing apparatus and more particularly to apparatus and method for processing relatively large tree logs to form relatively small firewood logs.

BACKGROUND OF THE INVENTION

Firewood logs are very desirable product formed by processing relatively large tree logs. There have been many types of apparatus marketed to accomplish the formation of the firewood logs. Some of these types are described in U.S. Pat. Nos. 4,782,866; 4,478,263; 4,373,564; 4,830,071; 4,830,070 and European Patent 0 054 252. However, there still exists a need for an efficient apparatus and method for processing relatively large tree logs into relatively small firewood logs.

BRIEF DESCRIPTION OF THE INVENTION

This invention provides apparatus and method for processing relatively large tree logs into relatively small firewood logs using two spaced apart cutting stations, a central conveyor, a transfer station and a splitter station wherein relatively large tree logs are placed sequentially onto an entrance portion of each of the two spaced apart cutting stations and are cut into rounds which are discharged onto the conveyor and moved to a transfer station. Each round is moved from the transfer station into a splitter station wherein each round is moved over splitter blades to form firewood logs.

In a preferred embodiment of the invention, the apparatus comprises a first station mounted at a first relatively fixed location and having a longitudinal axis and a second station mounted at a second relatively fixed location and having a longitudinal axis and wherein the first and second stations are in a spaced apart generally parallel relationship. Each of the first and second stations has an entrance portion for successively receiving a relatively large tree log that is relatively large in both length and transverse cross-sectional area and a discharge portion. Conveyor means are provided on each of the first and second stations for moving the relatively large tree log from the entrance portion to the discharge portion. Cutting means are provided on each of the first and second stations for cutting the relatively large tree log into a plurality of rounds each having predetermined longitudinal length.

A third station is mounted at a relatively fixed location and has a longitudinal axis which extends in a direction generally parallel to and is located between the longitudinal axes of the first and second stations. The third station has a receiving portion opposite to each of the discharge portions of the first and second stations. Discharging means are provided for moving the plurality of rounds from the discharge portions to the receiving portion. The third station has a transfer portion. Moving means are provided for moving the plurality of rounds from the receiving portion to the transfer portion. Splitting apparatus, preferably having a longitudinal axis substantially parallel to and spaced from the longitudinal axis of the third station, is provided for splitting each of the plurality of rounds into relatively small firewood logs, each having a transverse cross-sectional area smaller than the transverse cross-sectional area of each of the plurality of rounds but a longitudinal length that is substantially the same as the longitudinal length of each of said plurality of rounds. Transfer means are provided for transferring each of the rounds from the transfer portion to the splitting apparatus. The above described apparatus may be mounted on one or more conventional flat bed trailers.

The splitting apparatus comprises a first portion located to receive at least one of the plurality of rounds; a plurality of splitting blades mounted at a substantially fixed position on one side of the first portion; and a movable plate located on the other side of the first portion for contacting the at least one of the plurality of rounds in the first portion. Force applying means are provided for applying a force to the movable plate to move the at least one of the plurality of rounds through the plurality of splitting blades to split the at least one of the plurality of rounds into relatively small firewood logs. The force applying means comprise a plurality of force applying units mounted in spaced apart relationship to apply a substantially uniform force on the movable plate.

The cutting means on each of the first and second stations comprises at least a first stop means for stopping the movement of the relatively large tree log over the first or second station. At least a first cutting means have a first cutting apparatus located a predetermined distance from the at least a first stop means for cutting at least a portion from the relatively large tree log with the portion having a predetermined length equal to the predetermined distance from the at least a first stop means to the first cutting apparatus. First moving means are provided for moving the at least first cutting means into and out of a cutting location. At least a second stop means are provided for stopping the movement of the at least a portion. At least a second cutting means have a second cutting apparatus located to cut the at least a portion into at least two sections. At least second moving means are provided for moving the at least a second cutting means into and out of a cutting location. At least another stop means are provided for stopping the movement of one of the at least two sections so that the one of the at least two sections is located in the discharge portion. At least one additional cutting means have another cutting apparatus for cutting the one of the at least two sections into the plurality of rounds and at least another moving means are provided for moving the at least another means into and out of a cutting location.

In another preferred embodiment of the invention, the cutting means on each of the first and second stations comprise at least a first stop means for stopping the movement for the relatively large tree log over the first or second station. At least a first cutting means are provided and comprise a first cutting apparatus located a predetermined distance from the at least a first stop means and a second cutting apparatus located a distance from the first cutting apparatus wherein such distance is the same as the predetermined distance. Moving means are provided for moving the first and second cutting apparatus into a cutting location for cutting at least two segments from the relatively large tree log wherein each of the at least two segments has a longitudinal length equal to the predetermined distance. At least another stop means are provided for stopping the movement of one of the at least two segments so that the one of the at least one of the at least two segments is located in the discharge portion. At least another cutting means has another cutting apparatus for cutting the one of the at least two segments into a plurality of rounds. At least another moving means are provided for moving the at least another cutting means into and out of a cutting location.

A preferred method for processing relatively large tree logs into relatively small firewood logs using at least two spaced apart cutting stations, a central conveyor, a transfer station and a splitter station comprises sequentially placing a relatively large tree log both in length and transverse cross-sectional area into an entrance portion of one or the other of the at least two spaced apart cutting stations; cutting the relatively large tree logs in each of the at least two spaced apart cutting stations into segments wherein each segment has a length less than the length of the relatively large tree log; moving each of the segments into a discharge portion of each of the at least two spaced apart cutting stations; cutting each of the segments in the discharge portion into a plurality of rounds, each of the rounds having a predetermined length equal to the desired length of the relatively small firewood logs; sequentially discharging the plurality of rounds from the discharge portion onto a receiving portion of the central conveyor; moving each of the plurality of rounds on the central conveyor into a transfer station; transferring at least one of the rounds into a splitter station and splitting the at least one of the rounds into firewood logs having substantially the same length as the at least one of the rounds but having a substantially smaller transverse cross-sectional area.

In a preferred embodiment of the invention the log splitting apparatus for splitting the log segments comprises a generally rectangular frame having a top wall, a bottom wall, a first sidewall and a second sidewall with each wall having front edges and back edges with the front edges lying in a first common plane and the back edges lying in a second common plane. At least two first supports, each comprising two support members, are secured to each of the first and second sidewalls in a spaced apart relationship. A first cutting blade is secured to an aligned two support members of that at least two first supports and each of the first cutting blades has a front edge lying in a third common plane and a back edge lying in a fourth common plane. At least two second supports, each comprising two support members, are secured to each of the top and bottom walls in a spaced apart relationship. A second cutting blade is secured to an aligned two support members of the at least two second supports and each of the second cutting blades has a front edge lying in the third common plane and a back edge lying in the fourth common plane with the second cutting blades being in a perpendicular relationship with the first cutting blades. At least two third supports, each comprising two support members, are secured to each of the first and second sidewalls in a spaced apart relationship and are located between the at least two first supports. A third cutting blade is secured to an aligned two support members of the at least third supports and each of the third cutting blades has a front edge lying in a fifth common plane and a back edge lying in a sixth common plane. At least two fourth supports, each comprising two support members, are secured to each of the top and bottom walls in a spaced apart, aligned relationship and are located between the at least two second supports. A fourth cutting blade is secured to an aligned two support members of the at least fourth supports and each of the fourth cutting blades has a front edge lying in said fifth common plane and a back edge lying in said sixth common plane with the fourth cutting blades being in a perpendicular relationship with the third cutting blades. At least one fifth support, comprising two support members, is secured to each of the first and second sidewalls and is located between the at least two third supports and the two support members are in an aligned relationship. A fifth cutting blade is secured to the two fifth support members and has a front edge and a back edge. At least one sixth support, comprising two support members, is secured to each of the top and bottom walls and is located between the at least two fourth supports and the two support members are in an aligned relationship. A sixth cutting blade is secured to the two sixth support members and has a front edge and a back edge. The front edges of the fifth and sixth blades lie in a seventh common plane and the back edges of the fifth and sixth cutting blades lie in an eighth common plane. A plurality of different spacing means are provided so that the distance between the two support members of the first, second, third, fourth, fifth and sixth supports is greater than the distance between the top and bottom walls and the distance between the first and second sidewalls. In a preferred embodiment of the invention, third common plane is in a substantially coinciding relationship with the second common plane; the fifth common plane is in a substantially coinciding relationship with the fourth common plane and the seventh common plane is in a substantially coinciding relationship with the sixth common plane.

In another preferred embodiment of the invention, the third common plane is spaced a distance from the second common plane, the fifth common plane is spaced a distance from the fourth common plane and the seventh common plane is spaced a distance from the sixth common plane. The first, second, third and fourth cutting blades have substantially the same width and the fifth and sixth cutting blades have the same width. The width of the first, second, third and fourth cutting blades is greater than the width of the fifth and sixth cutting blades.

BRIEF DESCRIPTION OF THE DRAWINGS

An illustrative and presently preferred embodiment of the invention is illustrated in the accompanying drawing in which.

DETAILED DESCRIPTION OF THE INVENTION

Figure 1:
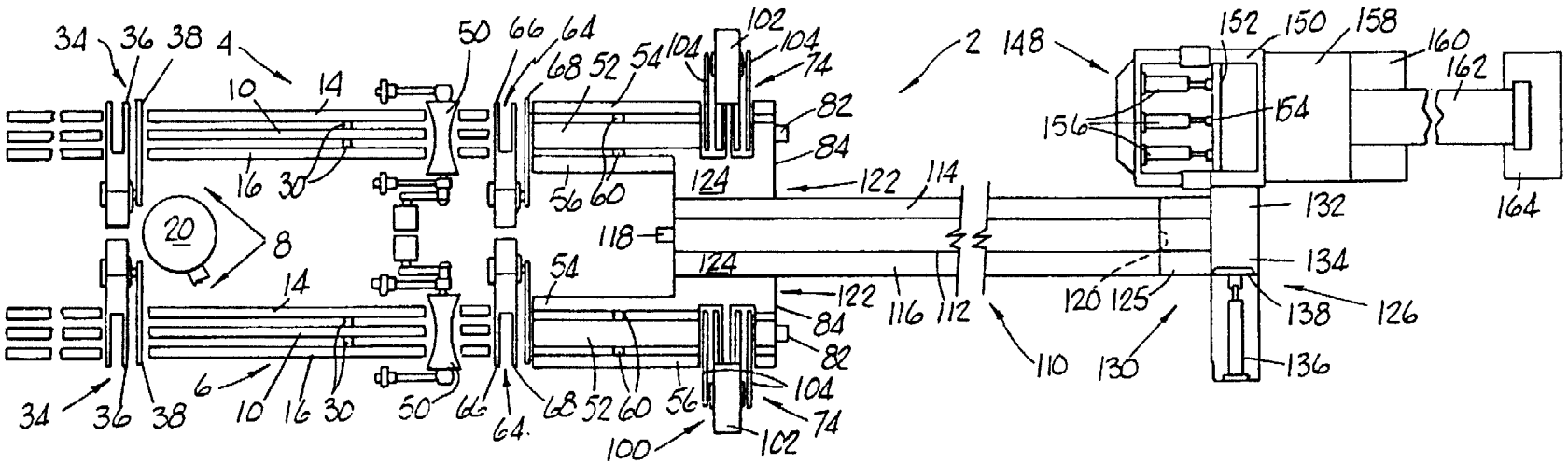
FIG. 1 is a schematic top plan view of a preferred embodiment of the apparatus of the invention.

In FIG. 1, there is schematically illustrated apparatus 2 of a preferred embodiment of the invention. The apparatus 2 comprises a first cutting station 4 and a second cutting station 6. In a preferred embodiment of the invention each of the first 4 and second 6 cutting stations has a longitudinal axis and they are located in a spaced apart parallel relationship. Each of the first 4 and second 6 cutting stations has an entrance portion 8 comprising a base rail 10 which supports a relatively large tree log 12 (FIG. 2) which is relatively large both in length and diameter or transverse cross-sectional area. On each side of the base rail 10, the entrance portion 8 has angularly related guide rails 14 and 16. Suitable means (not shown) are provided for moving the relatively large tree log 12 over the base rail 10 and the guide rails 14 and 16. A operator 18 uses conventional apparatus 20 to place in sequence a relatively large tree log 12 on the entrance portions 8 from a stockpile (not shown) of relatively large tree logs 12.

Movable stop means 30 are moved between a stopping position (illustrated in FIG. 2) and a non-stopping position (not shown) by conventional moving apparatus 32. When in the stopping position, the movable stop means 30 function to stop the movement of the relatively large tree log 12 over the entrance portion 8. A cutting means 34 comprises a conventional clamping device 36 and a conventional saw 38 which saw 38 is mounted at a predetermined distance from the stop means 30. When the end surface 40 of the relatively large tree log 12 has been moved into contact with the movable stop means 30, a control device (not shown) operates the cutting means 34 so that the clamping device 36 holds the relatively large tree log 12 while the saw 38 is moved through the relatively large tree log 12 to cut a portion 42 from the relatively large tree log 12. The distance between the movable stop means 30 and the saw 38 depends upon the desired length of the relatively small firewood logs 44. In a preferred embodiment of the invention, this predetermined distance is eight feet.

After being cut, the portion 42 is moved over the remaining portion of the entrance portion 8 into contact with conventional moving means 50 which move the portion 42 onto a movable conveyor 52. On each side of the movable conveyor 52 there are angularly related guide plates 54 and 56. The portion 42 is moved by the moving means 50 and the conveyor 52 until the end portion 58 moves into contact with movable stop means 60 which are moved between a stopping position and a non-stopping position by conventional moving means 62. Cutting means 64 which are moved into and out of an operating position by suitable moving means (not shown) comprise a conventional clamping device 66 and a conventional saw 68 which saw 68 is mounted at a predetermined distance from the movable stop means 60. When the end surface 58 of the portion 42 has been moved into contact with the movable stop means 60, a control device (not shown) operates the cutting means 64 so that the clamping device 66 holds the portion 42 while the saw 68 is moved through the portion 42 to cut the portion 42 into two segments 70 and 72 of equal length. As stated above the portion 42 preferably has a length of eight feet, therefore, each of the segments 70 and 72 has a length of about four feet. As successive portions 42 are cut from the relatively large tree log 12, the diameter of the successive portions becomes smaller. After the segments 70 and 72 have been cut, the conveyor 52 is actuated to move the first segment 70 into a discharge portion 74 of the apparatus 2. The conventional moving means 50 are not actuated so that the segment 72 remains in place.

The conveyor 52 extends between end rolls 80 and 82 and moves the segment 70 into contact with an end wall 84 of the discharge portion 74. A movable positioning stop 86 which is moved into and out of an operating position by conventional moving means 88 functions to permit the movement of the segment 70 into the discharge portion 74 and then to retain the segment 70 in the discharge portion 74. After the segment 70 has been moved into the discharged portion 74, the moving means 50 and the conveyor 52 move the segment 72 against the positioning stop 86 and the front end portion of another portion 42 is moved onto the conveyor 52 to be cut into segments 70 and 72.

Each discharge portion 74 is provided with cutting means 100 which are moved into and out of an operating position by suitable moving means (not shown) and which comprises a conventional clamping device 102 and a conventional saw 104 on each side of the clamping device 102. If desired, movable holding means (not shown) can be provided to contact spaced apart upper outer portions of the segment 70 to hold segment 70 in the discharge portion 74. A control device (not shown) operates the cutting means 100 so that the clamping device 102 holds the segment 70 while the saws 104 are moved through the segment 70 to cut the segment 70 into three rounds 106. As stated above, the segment 70 has a length of about four feet so that each round 106 has a length of about sixteen inches.

Figure 2:
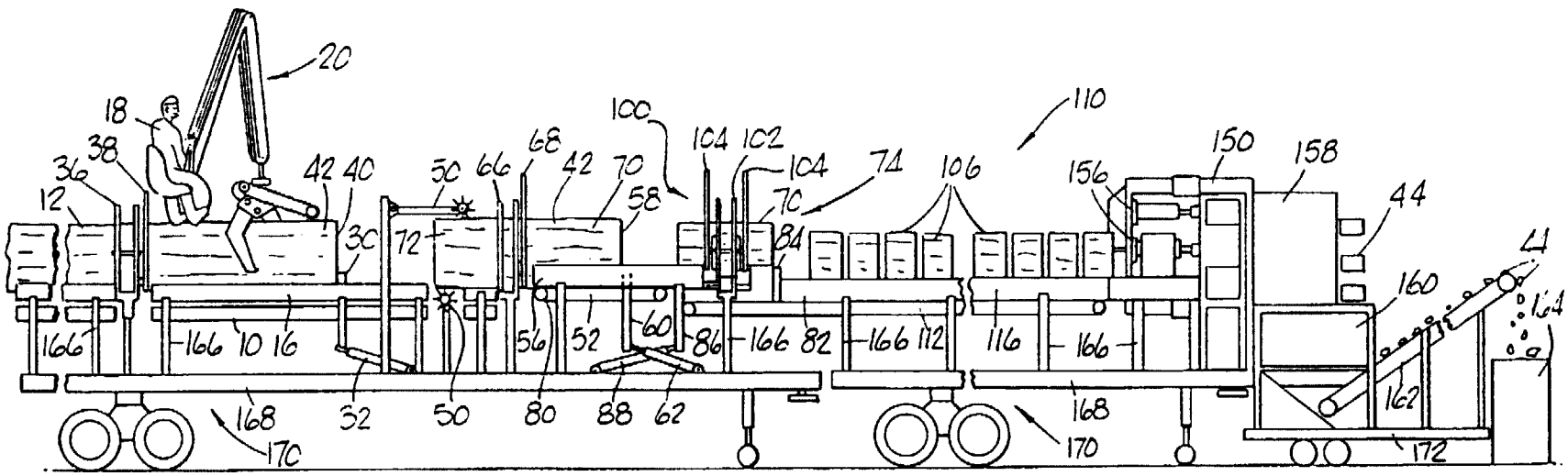
FIG. 2 is a side elevational view of FIG. 1 and illustrates the processing of a relatively large tree log into relatively small firewood logs.

The apparatus 2 also has a third station 110 which has a longitudinal axis which is spaced from and parallel to the longitudinal axes of the first 4 and second 6 cutting stations. The third station 110 has a movable conveyor 112 located between angularly related guide surfaces 114 and 116. The movable conveyor 112 is journalled between rolls 118 and 120 and is located in a plane below the plane of the movable conveyors 52. The central conveyor portion 110 has a receiving portion 122 so that, after the segment 70 has been cut into the rounds 106, the rounds 106 are moved out of the discharge portion 74 by suitable means (not shown) and roll over inclined surfaces 124 and portions of the guide surfaces 114 and 116 onto the conveyor 112. The conveyor 112 is provided with conventional separating means (not shown) so that the rounds 106 on the conveyor 112 are in a spaced apart relationship as illustrated in FIG. 2. The conveyor 112 moves the rounds 106 from the receiving portion 122 to a transfer portion 126 of the apparatus 2.

The transfer portion 126 has a first portion 130 (FIG. 1) for receiving one of the rounds 106 from the conveyor 112. The first portion 130 has a bottom surface 132 for supporting a round 106 and an end wall 134 for limiting the movement of the round 106 into the first portion 130. Conventional means 136 are mounted adjacent to the first portion 130 and function to move a round 106 from the first portion 130 into the splitter means 148 of the apparatus 2.

The splitter means 148 has a housing 150 for receiving a round 106. A movable plate 152 is secured on the ends 154 of a plurality 156 of force applying means, such as hydraulic or air cylinders, so that the forces applied by the movable plate 152 will be equally distributed across the facing surface of the round 106 in the housing 150. A log splitting apparatus 158 is located on the other side of the housing 150 and has a plurality of splitter blades (FIGS. 4–10) mounted therein. As the round 106 is moved by the movable plate 152 over the splitter blades, the round 106 is split into a plurality of firewood logs 44 which fall into the hopper 160 which has a conventional means for retaining the firewood logs 44 therein but permitting scrap material to pass therethrough. An inclined conveyor 162 removes the firewood logs 44 from the hopper 160 and deposits them into dump trucks 164 to be hauled away for windrowing and drying.

As illustrated in FIG. 2, the majority of the apparatus 2 is dimensioned so that it can be mounted by suitable supports 166 on the flat bed 168 of two conventional trailer 170 so that it can be moved from one tree log splitting site to another tree log splitting site. Also, the hopper 160 and the inclined conveyor 162 are mounted on a flat bed 172 so that they can be similarly moved.

In operation, the operator 18 will sequentially remove a relatively large tree log 12 from a stock pile and place such relatively tree log 12 into the entrance portion 8 of one of the first 4 or second 6 cutting stations. The relatively large tree log 12 is then moved against the stop 30 and a portion 42 is cut therefrom. The portion 42 is then moved by the moving means 50 so that a first portion thereof is located over the conveyor 52. The cutting means 64 are then used to cut the portion 42 into the segments 70 and 72. If desired, the cutting means 34 and 64 and particularly the saws 38 and 68 can be so located that, instead of first cutting the portion 42, the segments 70 and 72 can be cut in one operation. The segment 70 is then moved into the discharge portion 74 and then the segment 72 is moved to a location adjacent to the discharge portion 74. The cutting means 100 are then actuated to cut the segment 70 into three rounds 106 which are the moved to the conveyor 112 which moves the rounds 106 to the transfer portion 136. The rounds 106 are then moved to the splitting means 148 where they are split into firewood logs 44 and then hauled away for windrowing and drying.

Figure 3:
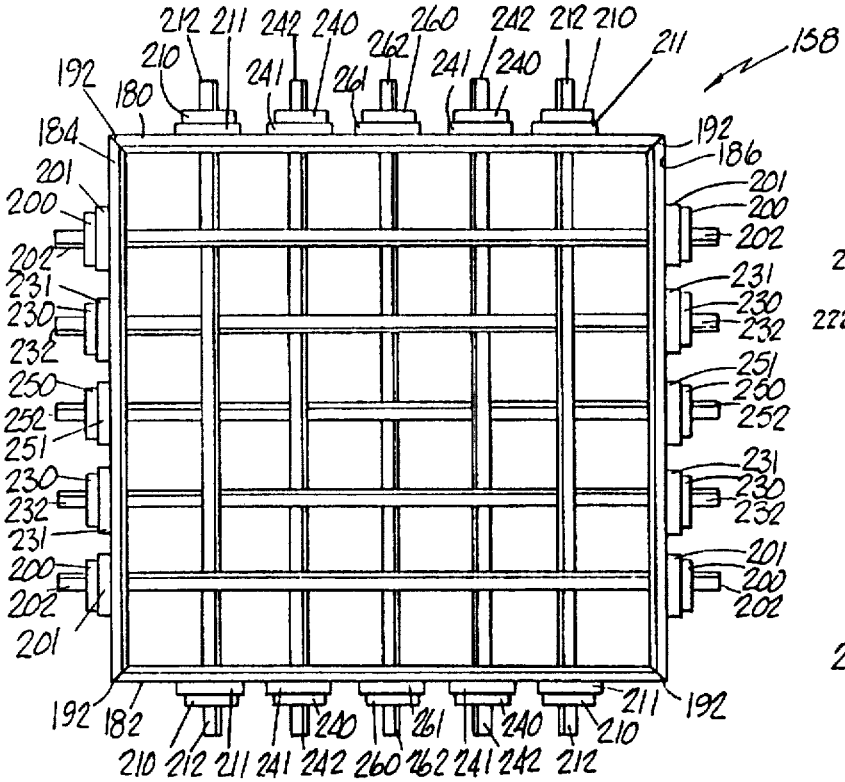
FIG. 3 is a front elevational view of a preferred embodiment of the log spitting apparatus of this invention.
Figure 4:
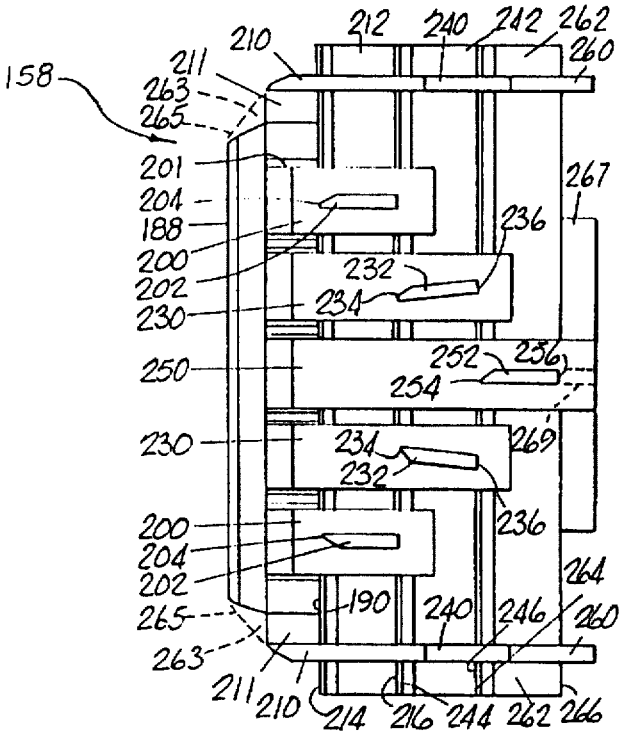
FIG. 4 is a side elevational view of FIG. 3.

The log splitting apparatus 158 is illustrated in FIGS. 3 and 4 and comprises a generally rectangular frame, preferably square, having a top wall 180, a bottom wall 182, a first sidewall 184 and a second sidewall 186, each having a front edge 188 and a back edge 190. The walls 180, 182, 184 and 186 are preferably formed from a mild steel or other materials having similar characteristics and are joined together by welded mitered joints 192. The front edges 188 lie in a first common plane and the back edges 190 lie in a second common plane.

Two first supports, each comprising two support members 200, are secured to spacer plates 201 which are second to the first or second sidewall 184 and 186 by conventional means, such as nuts and bolts or by welding (not shown), so that the distance between each two aligned first support members 200 is greater than the distance between the first and second sidewalls 184 and 186. A first cutting blade 202 is secured to an associated first support member 200 by passing through an opening in the first support member 200 and, if desired, is secured to the first support member 200 by conventional means, such as by welding (not shown). Each of the first cutting blades 202 has a front edge 204 and a back edge 206, FIGS. 5 and 6, with the front edges 204 lying in a third common plane and the back edges 206 lying in a fourth common plane.

Figure 5:
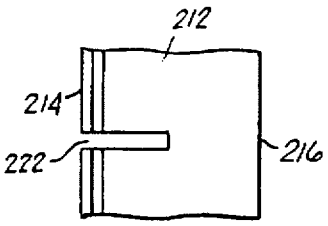
FIG. 5 is a plan view of a portion of one of the cutting blades of this invention.
Figure 6:
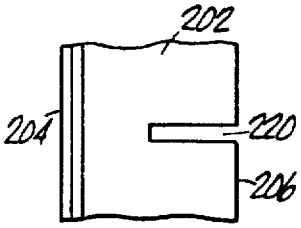
FIG. 6 is a plan view of a portion of another of the cutting blades of this invention.

Two second supports, each comprising two support members 210, are secured to spacer plates 211 which are secured to the top or bottom walls 180 or 182 by conventional means, such as nuts and bolts or by welding (not shown) so that the distance between each two aligned second support members 210 is greater than the distance between the top and bottom walls 180 and 182. A second cutting blade 212 is secured to an associated second support member 210 by passing through an opening in the second support member 210 and, if desired, secured to the second support member 210 by conventional means, such as by welding (not shown). Each of the second cutting blades 212 has a front edge 214 and the back edge 216 with the front edge 214 lying in the third common plane and the back edges 216 lying in the fourth common plane. The structure that permits the front edges 204 and 214 to lie in the third common plane and the back edges 206 and 216 to lie in the fourth common plane is illustrated in FIGS. 5 and 6. Each first cutting blade 202 has an open ended slot 220 formed therein with its opening in the back edge 206. Each second cutting blade 212 has an open ended slot 222 formed therein with its opening in the front edge 214.

Two third supports, each comprising two support members 230, are secured to spacer plates 231 which are secured to the first or second sidewall 184 or 186 by conventional means, such as nuts and bolts or by welding (not shown) so that the distance between each two aligned third support members 230 is greater than the distance between the first and second sidewalls 184 and 186. A third cutting blade 232 is secured to an associated third support member 230 by passing the third cutting blade 232 through an opening in the third support member 230 and, if desired, is secured to the third support member 230 by conventional means, such as by welding (not shown). Each of the third cutting blades 202 has a front edge 234 and a back edge 236 with the front edges 234 lying in a fifth common plane and the back edges 236 lying in a sixth common plane.

Two fourth supports, each comprising two support members 240, are secured to spacer plates 241 which are secured to the top or bottom wall 180 or 182 by conventional means, such as nuts and bolts or by welding (not shown) so that the distance between each two aligned fourth support members 240 is greater than the distance between the top and bottom walls 180 and 182. A fourth cutting blade 242 is secured to an associated fourth support member 240 by passing the fourth cutting blade 242 through an opening in the fourth support member 240 and, if desired, is secured to the fourth support member 240 by conventional means, such as by welding (not shown). Each of the fourth cutting blades 242 has a front edge 244 and a back edge 246 with the front edges 244 lying in the fifth common plane and the back edges 246 lying in the sixth common plane. This relationship is permitted by open ended slots in the third and fourth cutting blades 232 and 242 similar to the open ended slots 220 and 222.

A fifth support, comprising two support members 250, is secured to spacer plate 251 which is secured to the first or second sidewalls 184 or 186 by conventional means, such as nuts and bolts or by welding (not shown) so that the distance between the two aligned fifth support members 250 is greater than the distance between the first and second sidewalls 184 and 186. A fifth cutting blade 252 is secured to an associated fifth support member 250 by passing the fifth cutting blade 252 through an opening in the fifth support member 250 and, if desired, is secured to the fifth support member 250 by conventional means, such as by welding (not shown). The fifth cutting blade 252 has a front edge 254 and a back edge 256.

A sixth support, comprising two support members 260, is secured to spacer plates 261 which are secured to the top or bottom wall 180 or 182 by conventional means, such as nuts and bolts or by welding (not shown) so that the distance between the two aligned sixth support member 260 is greater than the distance between the top and bottom walls 180 and 182. A sixth cutting blade 262 is secured to an associated sixth support member 260 by passing the sixth cutting blade 262 through an opening in the sixth support member 260 and, if desired, is secured to the sixth support member 260 by conventional means, such as by welding (not shown). The sixth cutting blade 262 has a front edge 264 and a back edge 266. The front edges 254 and 264 lie in a seventh common plane and the back edges 256 and 266 lie in an eight common plane. This relationship is permitted by open ended slots in the fifth and sixth cutting blades 252 and 262 similar to the open ended slots 220 and 222.

Figure 7:
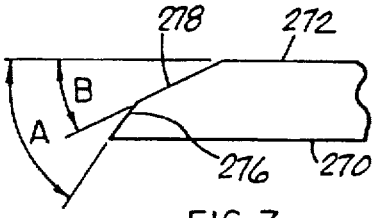
FIG. 7 is a side elevational view of a portion of the cutting blades in FIGS. 5 and 6.

If desired, a block 263 having an inclined surface 265 can be secured to each of the support plates 201, 211, 231, 241, 251 and 261. Also, a reinforcing bar 267 can be secured to the back edge 266 and another reinforcing bar 269 can be secured to the back edge 256. The construction of the front portion of each of the walls 180, 182, 184 and 186 and of the cutting blades 202, 212, 232, 242, 252 and 262 is illustrated in FIG. 7. Each has two opposite parallel planar surfaces 270 and 272, a first inclined surface 276 that has an angular relationship A with the planar surface 270 of between about 40 and 50 degrees and preferably of about 45 degrees and a second inclined surface 278 that has an angular relationship B with the planar surface 270 of between about 20 and 30 degrees and preferably of about 25 degrees. The inclined surfaces 276 and 278 are located so as to direct the cut wood in an outward direction from the horizontal and vertical center lines of the generally rectangular frame formed by the top and bottom walls 180 and 182 and the first and second sidewalls 184 and 186. Also, the cutting blades 202, 212, 232 and 242 are mounted at an inclined angle of between about 4 and 8 degrees and preferably of about 6 degrees so that the outer surface thereof directs the cut wood in an outward direction. The cutting blades 202, 212, 232, 242, 252 and 262 are preferably formed from a T-111 steel or other materials having similar characteristics.

Figure 8:
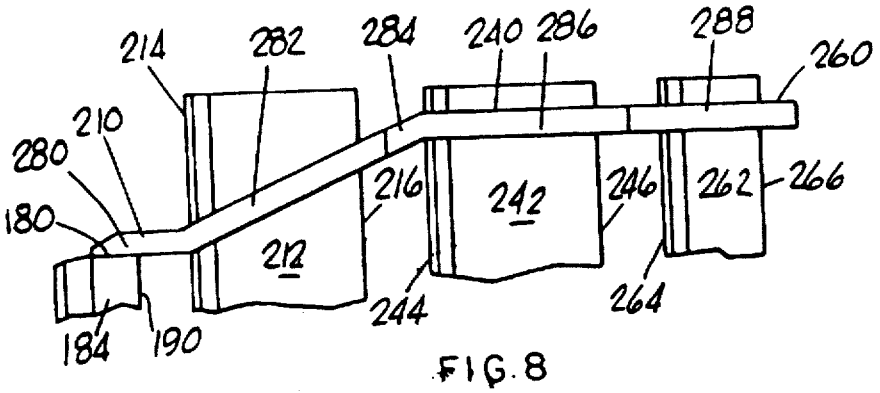
FIG. 8 is a partial side elevation view of another preferred embodiment of the invention.

Another preferred embodiment of the invention for spacing the two first, third and fifth support members 200, 230 and 250 apart a distance greater than the distance between the first and second sidewalls 184 and 186 and for spacing the two second, fourth and sixth support members 210, 240 and 260 apart a distance greater than the distance between the top and bottom walls 180 and 182 is illustrated in FIG. 8. Only the second, fourth and sixth support members 210, 240 and 260 are illustrated in FIG. 8 but all of the support members will have the same structures. The first portion 280 of the second support member 210 is secured to the top wall 180 and extends therefrom in a direction parallel thereto so that a space exists between the back edge 190 and the front edge 214. The second portion 282 of the second support member 210 extends from the first portion 280 at an angle of between about 20 and 30 degrees and preferable at an angle of about 25 degrees. The fourth support member 240 has first and second portions 280 and 282, similar to those of the second support member, and a third portion 284 that in an extension of the second portion 282 and a fourth portion 286 that is parallel to the first portion 280. The back edge 216 of the second cutting blade 212 is spaced from the front edge 244 of the fourth cutting blade 242. The sixth support member 260 has portions similar to the first, second, third and fourth portions 280, 282, 284 and 286 and a fifth portion 288 that is aligned with the fourth portion 286. In this embodiment, the first, second, third and fourth cutting blades 202, 212, 232 and 242 have the same width and the fifth and sixth cutting blades 252 and 262 have the same width. The width of the first, second, third and fourth cutting blades 202, 212, 232 and 242 is greater than the width of the fifth and sixth cutting blades 252 and 262 and preferably the width is twice as great. The front edges of the first and second cutting blades 202 and 212 are spaced from the back edges of the top and bottom walls 180 and 182 and the first and second sidewalls 184 and 186; the front edges of the third and fourth cutting blades 232 and 242 are spaced from the back edges of the first and second cutting blades 202 and 212; and the front edges of the fifth and sixth cutting blades 252 and 262 are spaced from the back edges of the third and fourth cutting blades 232 and 242. In all instances, the spacing is between about 3.5 and 4.5 inches and preferably about 4.0 inches. In FIG. 8, only the cutting blades 212, 242 and 262 are illustrated. In some instances, it may be desirable to add reinforcing means to the portions 282, 286 and 288.

Figure 9:
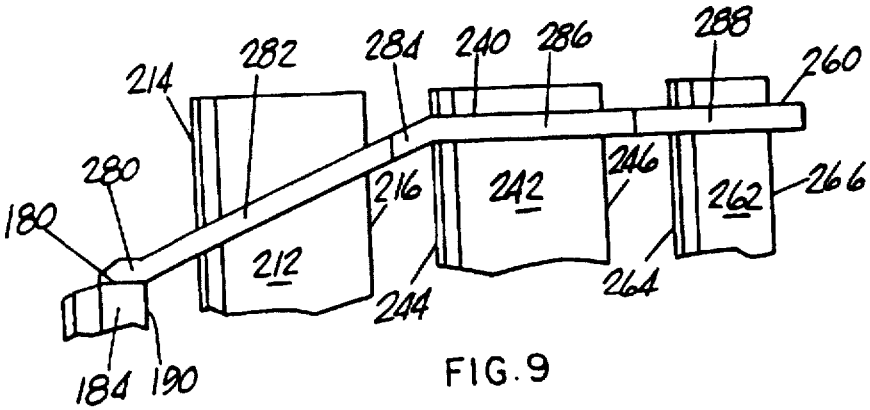
FIG. 9 is a partial side elevational view of another preferred embodiment of the invention.

Another preferred embodiment of the invention for spacing the two first, third and fifth support members 200, 230 and 250 apart a distance greater than the distance between the first and second sidewalls 184 and 186 and for spacing the two second, fourth and sixth support members 210, 240 and 260 apart a distance greater than the distance between the top and bottom walls 180 and 182 is illustrated in FIG. 9. The difference between FIGS. 8 and 9 is that the second angled portion 282 begins at the back edge 190.

Figure 10:
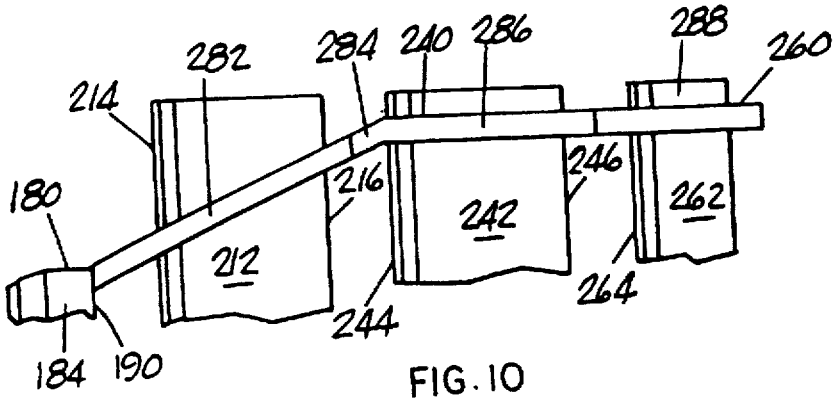
FIG. 10 is a partial side elevational view of another preferred embodiment of the invention.

Another preferred embodiment of this invention for spacing the two first, third and fifth support members 200, 230 and 250 apart a distance greater than the distance between the first and second sidewalls 184 and 186 and for spacing the two second, fourth and sixth support members 210, 240 and 260 apart a distance greater than the distance between the top and bottom walls 180 and 182 is illustrated in FIG. 10. The difference in FIG. 10 is that the angled portion 282 is secured to the back edge 190 of the top wall 180 directly by suitable means, such a as by welding (not shown).

The outward spacing of the first, second, third, fourth, fifth and sixth supports 200, 210, 230, 240, 250 and 260 functions to prevent binding of the split log as it passes through the log splitting apparatus 158.

Although the original tree log and the rounds cut therefrom are illustrated as being the same size, it is understood that this is for illustration purposes only. The apparatus disclosed in this application is particularly designed for use with tree logs having a diameter of about thirty-six inches at the large end thereof and a diameter of about twelve inches at the small end thereof. Accordingly, as the smaller rounds are pushed through the splitter blades, they will contact fewer splitter blades.

It is contemplated that the inventive concepts herein described may be variously otherwise embodied and it is intended that the appended claims be construed to include alternative embodiments of the invention except insofar as limited by the prior art.

What is claimed:

1. Apparatus for processing relatively large tree logs into relatively small firewood logs comprising:

a first station mounted at a first relatively fixed location and having a longitudinal axis;

a second station mounted at a second relatively fixed location and having a longitudinal axis;

said first and second stations being in a spaced apart generally parallel relationship;

each of said first and second stations having an entrance portion for successively receiving a relatively large tree log both in length and transverse cross-sectional area;

each of said first and second stations having a discharge portion;

conveyor means on each of said first and second stations for moving said relatively large tree log from said entrance portion to said discharge portion;

cutting means on each of said first and second stations for cutting said relatively large tree log into a plurality of rounds, each of said rounds having substantially the same longitudinal length;

a third station mounted at a relatively fixed location and having a longitudinal axis;

said longitudinal axis of said third station extending in a direction generally parallel to and located between said longitudinal axes of said first and second stations;

said third station having a receiving portion opposite to said discharge portion of each of said first and second stations;

discharging means for moving said plurality of rounds from said discharge portions to said receiving portion;

said third station having a transfer portion;

moving means for moving said plurality of rounds from said receiving portion to said transfer portion;

splitting apparatus for splitting each of said plurality of rounds into relatively small firewood logs each having a transverse cross-sectional area smaller than the transverse cross-sectional area of each of said plurality of rounds but having substantially said same longitudinal length; and transfer means for transferring each of said rounds from said transfer portion to said splitting apparatus.

2. Apparatus as in claim 1 and further comprising:

said splitting apparatus having a longitudinal axis parallel to and spaced from said longitudinal axis of said third station.

3. Apparatus as in claim 1 wherein said splitting apparatus comprises:

a first portion located to receive at least one of said plurality of rounds;

a plurality of splitting blades mounted at a substantially fixed position on one side of said first portion;

a movable plate located on the other said of said first portion for contacting said at least one of said plurality of rounds in said first portion; and force applying means for applying a force to said movable plate to move said at least one of said plurality of rounds through said plurality of splitting blades to split said at least one of said plurality of rounds into relatively small firewood logs.

4. Apparatus as in claim 3 wherein said force applying means comprise:

a plurality of force applying units mounted in spaced apart relationship to apply a substantially uniform force on said movable plate.

5. Apparatus as in claim 4 and further comprising:

said splitting apparatus having a longitudinal axis parallel to and spaced from said longitudinal axis of said third station.

6. Apparatus as in claim 1 wherein said cutting means on each of said first and second stations comprises:

at least a first stop means for stopping the movement of said relatively large tree log over said first or second station;

at least a first cutting means having a first cutting apparatus located a predetermined distance from said at least a first stop means for cutting at least a portion from said relatively large tree log, said portion having a predetermined length equal to said predetermined distance from said at least a first stop means to said at least a first cutting apparatus;

first moving means for moving said at least first cutting means into and out of a cutting location;

at least a second stop means for stopping the movement of said at least a portion;

at least second cutting means having a second cutting apparatus located to cut said at least a portion into at least two sections of equal length;

second moving means for moving said at least a second cutting means into and out of a cutting location;

at least another stop means for stopping the movement of one of said at least two sections so that said one of said at least two sections is located in said discharge portion;

at least one another cutting means having another cutting apparatus for cutting said one of said at least two sections into said plurality of rounds; and at least one another moving means for moving said at least one additional cutting means into and out of a cutting location.

7. Apparatus as in claim 6 and further comprising:

said splitting apparatus having a longitudinal axis parallel to and spaced from said longitudinal axis of said third station.

8. Apparatus as in claim 6 wherein said splitting apparatus comprises:

a first portion located to receive at least one of said plurality of rounds;

a plurality of splitting blades mounted at a substantially fixed position on one side of said first portion;

a movable plate located on the other said of said first portion for contacting said at least one of said plurality of rounds in said first portion; and force applying means for applying a force to said movable plate to move said at least one of said plurality of rounds through said plurality of splitting blades to split said at least one of said plurality of rounds into relatively small firewood logs.

9. Apparatus as in claim 8 wherein said force applying means comprise:

a plurality of force applying units mounted in spaced apart relationship to apply a substantially uniform force on said movable plate.

10. Apparatus as in claim 9 and further comprising:

said splitting apparatus having a longitudinal axis parallel to and spaced from said longitudinal axis of said third station.

11. Apparatus as in claim 1 wherein each of said first and second stations comprise:

at least a first stop means for stopping the movement of said relatively large tree log over said first or second station;

at least a first cutting means having a first cutting apparatus located a predetermined distance from said at least a first stop means and a second cutting apparatus located a distance, the same as said predetermined distance, from said first cutting apparatus;

moving means for moving said first and second cutting apparatus into a cutting location for cutting at least two segments from said relatively large log wherein each of said at least two segments has a longitudinal length equal to said predetermined distance;

at least another stop means for stopping the movement of one of said at least two segments so that said one of said at least two segments is located in said discharge portion;

at least another cutting means having another cutting apparatus for cutting means for cutting said one of said at least two segments into said plurality of rounds; and at least another moving means for moving said at least one additional cutting means into and out of a cutting location.

12. Apparatus as in claim 11 wherein said splitting apparatus comprises:

a housing located to receive at least one of said plurality of rounds;

a plurality of splitting blades mounted at a substantially fixed position on one side of said housing;

a movable plate located on the other said of said housing for contacting said at least one of said plurality of rounds in said housing; and force applying means for applying a force to said movable plate to move said at least one of said plurality of rounds through said plurality of splitting blades to split said at least one of said plurality of rounds into relatively small firewood logs.

13. Apparatus as in claim 12 wherein said force applying means comprise:

a plurality of force applying units mounted in spaced apart relationship to apply a substantially uniform force on said movable plate.

14. Apparatus as in claim 1 wherein said splitting apparatus comprises:

a generally rectangular frame having a top wall, a bottom wall, a first sidewall and a second sidewall, each having a front edge and a back edge;

said front edges lying in a first common plane and said back edges lying in a second common plane;

at least two first supports secured to each of said first and second sidewalls in a spaced apart relationship;

each of said two first supports comprising two aligned support members;

a first cutting blade secured to said aligned two support members of said at least two first supports;

each of said first cutting blades having a front edge lying in a third common plane and a back edge lying in a fourth common plane;

at least two second supports secured to each of said top and bottom walls in a spaced apart, aligned relationship;

each of said at least two second supports comprising two aligned support members;

a second cutting blade secured to said aligned two support members of said at least second supports;

each of said second cutting blades having a front edge lying in said third common plane and a back edge lying in said fourth common plane;

said second cutting blades being in a perpendicular relationship with said first cutting blades;

at least two third supports secured to each of said first and second sidewalls in a spaced apart, aligned relationship and located between said at least two first supports;

each of said at least two third supports comprising two aligned support members;

a third cutting blade secured to said aligned two support members of said at least third supports;

each of said third cutting blades having a front edge lying in a fifth common plane and a back edge lying in a sixth common plane;

at least two fourth supports secured to each of said top and bottom walls in a spaced apart relationship and located between said at least two second supports;

each of said at least two fourth supports comprising two support members;

a fourth cutting blade secured to said aligned two support members of said at least fourth supports;

each of said fourth cutting blades having a front edge lying in said fifth common plane and a back edge lying in said sixth common plane;

said fourth cutting blades being in a perpendicular relationship with said third cutting blades;

at least one fifth support secured to each of said first and second sidewalls and located between said at least two third supports;

said at least one fifth support comprising two aligned support members;

a fifth cutting blade secured to said two aligned fifth support members of said at least one fifth support;

said fifth cutting blade having a front edge and back edge;

at least one sixth support secured to each of said top and bottom walls and located between said at least two fourth supports;

said at least one sixth support comprising two aligned support members;

a sixth cutting blade secured to said two aligned sixth support members of said at least one sixth support;

said sixth cutting blade having a front edge and a back edge;

said front edges of said fifth and sixth cutting blades lying in a seventh common plane; and said back edges of said fifth and sixth cutting blades lying in an eighth common plane.

15. Log splitting apparatus for splitting log segments being pushed therethrough comprising:

a generally rectangular frame having a top wall, a bottom wall, a first sidewall and a second sidewall, each having a front edge and a back edge;

said front edges lying in a first common plane and said back edges lying in a second common plane;

at least two first supports secured to each of said first and second sidewalls in a spaced apart relationship;

each of said two first supports comprising two aligned support members;

a first cutting blade secured to said aligned two support members of said at least two first supports;

each of said first cutting blades having a front edge lying in a third common plane and a back edge lying in a fourth common plane;

at least two second supports secured to each of said top and bottom walls in a spaced apart, aligned relationship;

each of said at least two second supports comprising two aligned support members;

a second cutting blade secured to said aligned two support members of said at least second supports;

each of said second cutting blades having a front edge lying in said third common plane and a back edge lying in said fourth common plane;

said second cutting blades being in a perpendicular relationship with said first cutting blades;

at least two third supports secured to each of said first and second sidewalls in a spaced apart, aligned relationship and located between said at least two first supports;

each of said at least two third supports comprising two aligned support members;

a third cutting blade secured to said aligned two support members of said at least third supports;

each of said third cutting blades having a front edge lying in a fifth common plane and a back edge lying in a sixth common plane;

at least two fourth supports secured to each of said top and bottom walls in a spaced apart relationship and located between said at least two second supports;

each of said at least two fourth supports comprising two support members;

a fourth cutting blade secured to said aligned two support members of said at least fourth supports;

each of said fourth cutting blades having a front edge lying in said fifth common plane and a back edge lying in said sixth common plane;

said fourth cutting blades being in a perpendicular relationship with said third cutting blades;

at least one fifth support secured to each of said first and second sidewalls and located between said at least two third supports;

said at least one fifth support comprising two aligned support members;

a fifth cutting blade secured to said two aligned fifth support members of said at least one fifth support;

said fifth cutting blade having a front edge and back edge;

at least one sixth support secured to each of said top and bottom walls and located between said at least two fourth supports;

said at least one sixth support comprising two aligned support members;

a sixth cutting blade secured to said two aligned sixth support members of said at least one sixth support;

said sixth cutting blade having a front edge and a back edge;

said front edges of said fifth and sixth cutting blades lying in a seventh common plane; and said back edges of said fifth and sixth cutting blades lying in an eighth common plane.

16. Log splitting apparatus as in claim 15 wherein:

the distance between said two aligned first, second, third, fourth, fifth and sixth support members is greater than the distance between said top and bottom walls and the distance between said first and second sidewalls.

17. Log splitting apparatus as in claim 16 wherein:

said third common plane being in a substantially coinciding relationship with said second common plane;

said fifth common plane being in a substantially coinciding relationship with said fourth common plane; and said seventh common plane being in a substantially coinciding relationship with said sixth common plane.

18. Log splitting apparatus as in claim 16 wherein:

said third common plane being spaced a distance from said second common plane;

said fifth common plane being spaced a distance from said fourth common plane; and said seventh common plane being spaced a distance from said sixth common plane.

19. Log splitting apparatus as in claim 18 wherein:

said first, second, third and fourth cutting blades having substantially the same width;

said fifth and sixth cutting blades having the same width; and said width of said first, second, third and fourth cutting blades being greater than said width of said fifth and sixth cutting blades.

20. A method for processing relatively large tree logs into relatively small firewood logs using at least two spaced apart cutting stations, a central conveyor, a transfer station and a splitter station comprising:

sequentially placing a relatively large tree log both in length and transverse cross-sectional area into an entrance portion of one or the other of said at least two spaced apart cutting stations;

cutting said relatively large tree log in each of said at least two spaced apart cutting stations into segments wherein each segment has a length less than the length of said relatively large tree log;

moving each of said segments into a discharge portion of each of said at least two spaced apart cutting stations;

cutting each of said segments in said discharge portion into a plurality of rounds, each of said rounds having a predetermined length equal to the desired length of the relatively small firewood logs;

sequentially discharging said plurality of rounds from said discharge portions onto a receiving portion of said central conveyor;

moving each of said plurality of rounds on said central conveyor into a transfer station;

transferring at least one of said rounds into a splitter station; and splitting said at least one of said rounds into firewood logs having substantially the same length as said at least one of said rounds but having a substantially smaller transverse cross-sectional area.

* * * * *